US007788768B2

(12) United States Patent
Yamamuro

(10) Patent No.: US 7,788,768 B2
(45) Date of Patent: Sep. 7, 2010

(54) DOOR CLOSER

(75) Inventor: Koichi Yamamuro, Kanagawa (JP)

(73) Assignee: NHK Spring Co., Ltd. (JP)

( * ) Notice: Subject to any disclaimer, the term of this patent is extended or adjusted under 35 U.S.C. 154(b) by 638 days.

(21) Appl. No.: 11/722,505

(22) PCT Filed: Dec. 15, 2005

(86) PCT No.: PCT/JP2005/023085

§ 371 (c)(1),
(2), (4) Date: Jun. 21, 2007

(87) PCT Pub. No.: WO2006/068034

PCT Pub. Date: Jun. 29, 2006

(65) Prior Publication Data

US 2009/0320236 A1 Dec. 31, 2009

(51) Int. Cl.
*E05F 1/08* (2006.01)

(52) U.S. Cl. ..... 16/79; 16/64

(58) Field of Classification Search ..... 16/71–72, 16/79, 85, 49, 64, DIG. 10, DIG. 17, DIG. 21, 16/62, 69; 49/386
See application file for complete search history.

(56) References Cited

U.S. PATENT DOCUMENTS 4,660,250 A * 4/1987 Tillman et al. ..... 16/58
5,417,013 A * 5/1995 Tillmann ..... 49/386
5,513,467 A * 5/1996 Current et al. ..... 49/340
5,687,507 A * 11/1997 Beran ..... 49/340
5,913,763 A * 6/1999 Beran et al. ..... 49/506
6,262,548 B1 * 7/2001 Scholten et al. ..... 318/445
2009/0265994 A1 * 10/2009 Suzuki et al. ..... 49/358

FOREIGN PATENT DOCUMENTS

| | | |
|---|---|---|
| JP | 57-2634 | 1/1982 |
| JP | 2-167975 | 6/1990 |
| JP | 9-53365 | 2/1997 |
| JP | 2004-143812 | 5/2004 |

* cited by examiner

*Primary Examiner*—William L. Miller
(74) *Attorney, Agent, or Firm*—Lowe Hauptman Ham & Berner, LLP

(57) ABSTRACT

A door closer that integrally incorporates a door-opening-assistance device, and that therefore eliminates the need for unnecessary troublesome adjustment between parts, and whose number of parts is reduced, making said door closer compact. The door closer 1 includes a closer 1*a* that includes a pinion 5 that rotates in the forward and reverse directions when the door is opened or closed, respectively. A cylinder 9 is meshed with the pinion 5 and moves forward and backward. A closing spring 14 energizes the door in the closing direction via the cylinder 9 and the pinion 5. A opening-assistance device 1*b* that includes an opening spring 22 that stores an opening force in the door-opening direction due to the movement of the cylinder 9 when the door is opened. Locking mechanisms 27, 28, and 29, that—when the door is opened—lock the opening spring 22 under an opening-force-storing condition. An unlocking mechanisms 23 and 24 that—when the door is closed—unlock the locking mechanisms. The closer 1*a* and the door-opening-assistance device 1*b* are inside the same case 6 and interlinked by the opening of the door.

11 Claims, 13 Drawing Sheets

DOOR CLOSER

CROSS-REFERENCE TO RELATED APPLICATIONS

The present Application is based on International Application No. PCT/JP2005/023085, filed on Dec. 15, 2005, which claims priority from Japan Application No. 2004-370254, filed Dec. 21, 2004 and Japan Application No. 2005-139135, filed on May 11, 2005, the disclosures of which are hereby incorporated by reference in their entirety into the present application.

FIELD OF THE INVENTION

The present invention relates to a door closer that provides force that is used to close the door, and more particularly relates to a door closer which is integrally assembled as an opening-assistance device that, when a person applies force on a door to open it, assists the user by giving additional force in the door-opening direction so that the opening of the door is facilitated.

BACKGROUND OF THE INVENTION

A door is provided with a door closer for surely closing the door. And in the case of either a building, such as a condominium building, that is made substantially airtight or a large door, a large force is required for opening a door, which imposes a large burden on children and the elderly. Therefore, a door-opening-assistance device is used to assist in opening a door in such a situation.

A conventional door-opening-assistance device is a member that is separate from a door closer, and it has a structure such that a slider is meshed with a shaft member that, because it is connected to the rotary shaft of the door closer, rotates and moves forward and backward, and such that an energizing spring stores door-opening force in accordance with the movement of the slider. Also, such a door-opening-assistance device includes both a locking member that locks the energizing spring so that the spring stores the door-opening force, and an unlocking member that unlocks the locking member by the closing of the door, and the locking member and unlocking member are in a housing separate from the door closer.

Such a separate type of door-opening-assistance device is mounted to the door closer after the door closer is mounted to the door, and the door is provided with door-opening force that can be used to counter the door closer's door-closing force, thereby reducing the amount of force needed to open the door. Accordingly, the door can be opened by a small amount of force. Patent Document 1: Japanese Patent Application Laid-Open No. 2004-143812

DISCLOSURE OF THE INVENTION

Problems To Be Solved by the Invention

A conventional door-opening-assistance device, however, is a member separate from a door closer, and it has a structure that requires it to be mounted to the door closer after the door closer is mounted to the door. Therefore, it is essential that the functioning of the door-opening-assistance device be synchronized with the functioning of the door closer, and this makes mounting the door-opening-assistance device troublesome. Also, a member to link the door-opening-assistance device with the door closer is required, and therefore a large number of parts is necessary, resulting in increased cost. Furthermore, because the door-opening-assistance device is mounted to the door closer after the door closer is mounted to the door, the size of the combination of the door closer and the door-opening-assistance device is large, which results in the problem of an unattractive appearance.

In light of such circumstances, one objective of the present invention is to provide a door closer that integrally incorporates itself inside door-opening-assistance device, that eliminates the need for troublesome adjustment of the functioning of the door closer with that of the door-opening assistance device, that reduces the number of parts used, and that can be made compact so as not to be unattractive.

Means for Solving the Problems

The door closer of the invention is arranged inside a single case and a closer, which moves the door in the closing direction and provides force that is used to close the door, and an opening-assistance device, which stores a door-opening force when the door is opened and provides door-opening force that can be used to counter the door closer's door-closing force, so that the functioning of the closer and the opening-assistance device interlink with each other when the door is opened.

The door closer of the invention includes a closer that has a pinion that rotates in the forward and reverse directions due to the opening and closing, respectively, of the door. A cylinder is meshed with the pinion and moves forward and backward. A closing spring that, via the cylinder and the pinion, provides force that is used to close the door. An opening-assistance device includes an opening spring that stores a door-opening force due to the rotation of the pinion when the door is opened. A locking mechanism locks the opening spring in the opening-force-storing condition when the door is opened. An unlocking mechanism that unlocks the locking mechanism when the door is closed.

The door closer is characterized such that closer and the opening-assistance device are arranged inside the same case so that the functioning of the closer and that of the opening-assistance device are linked together when the door is opened.

Another aspect of the invention is that the case is separated into first and second chambers that are isolated from each other. The cylinder is formed of a first cylinder part that receives the force of the closing spring, and a second cylinder part that is meshed with the pinion. The closing spring and the first cylinder part are inside the first chamber, and the pinion, the second cylinder part, and the door-opening-assistance device are inside the second chamber, with the first and second cylinder parts connected with each other.

Another aspect of the invention is that the opening-assistance device the opening spring, the locking mechanism, the unlocking mechanism, and a fixing member that extends along the moving direction of the cylinder under a fixed condition at one end of the case. A moving member receives the force of the opening spring, that can make contact with the cylinder, and moves along the fixing member due to the moving force between itself and the cylinder. The locking mechanism has locking balls that lock the movement of the moving member due to the opening of the door and then lock the opening spring in an opening-force-storing condition. Due to the closing of the door, the moving member releases the locking balls' locking of the movement of the moving member.

Another aspect of the invention that the closer and the opening-assistance device are confronted with each other inside the case in a straight line along the direction of the cylinder reciprocating motion.

Another aspect of the invention is that the opening spring applies the opening force due to the rotation of the pinion within a predetermined angle at an initial door-opening stage, stores the opening force, and is locked in the opening-force-storing condition.

Another aspect of the invention is that there is formed on the pinion a cam face that contacts the moving member, and the cam face is formed so that the opening spring applies the opening force due to the rotation of the pinion within a predetermined angle at the initial stage of the opening of the door, stores the opening force, and is locked in the opening-force-storing condition.

Another aspect of the invention is that the locking mechanism has a locking spring that moves the locking balls to a position for locking the movement of the moving member. The unlocking mechanism has an unlocking spring that opposes the locking spring. The unlocking spring has a spring force that is larger than the spring force of the locking spring when the initial load of the spring force is set so that the opening spring applies the opening force, and that is smaller than the spring force of the locking spring when the opening spring is locked in the opening-force-storing condition.

SUMMARY OF THE INVENTION

According to the invention there is inside a single case both a door-opening-assistance device that provides a door-opening force that can be used to counter the door closer's door-closing force and a closer that moves the door in the closing direction and provides force that is used to close the door. Therefore, an entire door closer assembly that combines a closer and a door-opening-assistance device can be made compact and improved in appearance. Also, the door-opening-assistance device and the closer are such that they work in connection with the opening of the door, and therefore, troublesome adjustment of the functioning of those two members is no longer necessary. In addition, the number of parts required is reduced, and therefore failure of the door closer occurs less frequently.

According to one aspect of the invention, the case is separated into a first chamber and a second chamber. Also, the closer is in the first chamber, and the door-opening-assistance device is in the second chamber—under the condition that first and second cylinder parts of the cylinder are connected with each other. Therefore, a change in the pressure in the first chamber does not influence the second chamber. Accordingly, the door-opening-assistance device in the second chamber is not influenced by the pressure in the first chamber, and therefore the door-opening-assistance device is capable of assisting the opening of the door smoothly and surely.

According to another aspect of the invention, in addition to the above-mentioned effects, an opening spring applies an opening force on the door within a predetermined angle at the beginning of the door opening action—for example, to a rotation angle of the door opened when just before a person can pass through the door. The opening spring stores an opening force, and, at the same time, is locked under an opening-force-storing condition. Accordingly, before the door is opened there can be completed a series of actions—that include applying the opening force in the door-opening direction up to a predetermined angle of the door opening, and then storing the opening force by a further door-opening action—to the extent that a person can pass through the doorway. Therefore, even if the door is closed before the door is fully opened after door opening starts, the opening spring stores the opening force, and thus door opening can surely be assisted.

According to another aspect of the invention, there is provided, in addition to the above-mentioned effects, an unlocking spring whose initial spring load is set, and therefore the opening spring can both surely apply an opening force and surely be locked under an opening-force-storing condition.

EXPLANATION OF NUMBERS USED IN THE DRAWINGS

Figure 1:
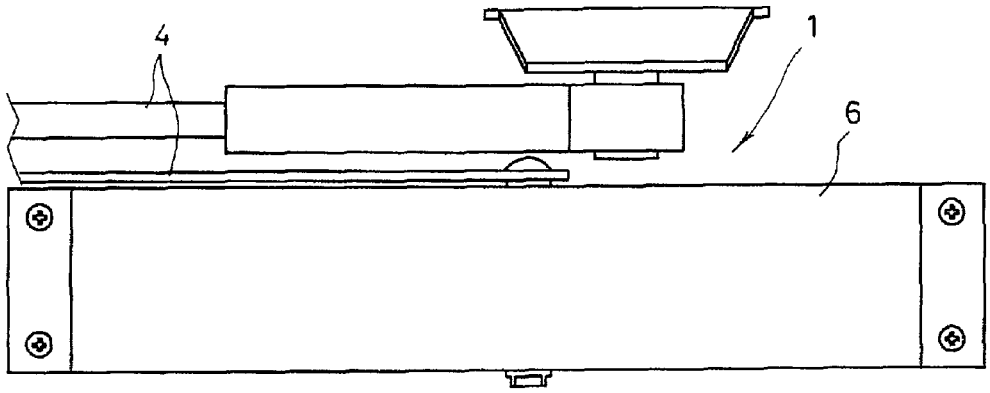
FIG. 1 is a front view of a door closer in one embodiment of the present invention.

1 door closer
1*a* closer
1*b* opening-assistance device
5 pinion
5*b* cam face
6 case
6*a* first chamber
6*b* second chamber
9 cylinder
14 closing spring
20 block
21 piston
22 opening spring
23 unlocking pin
24 unlocking spring
25 stop pin
26*a*, 26*b* spring bearings
27 locking ball
28 locking pin
29 locking spring
91 first cylinder part
92 second cylinder part

BEST MODE FOR CARRYING OUT THE INVENTION

Figure 2:
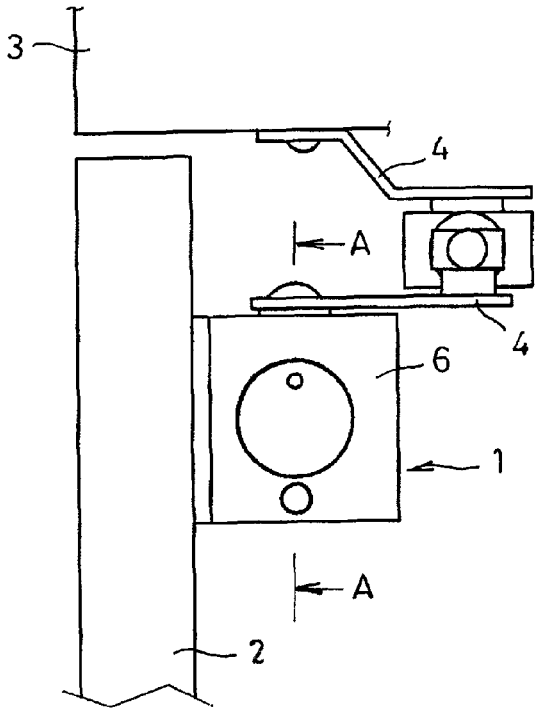
FIG. 2 is a left-side view of FIG. 1.
Figure 3:
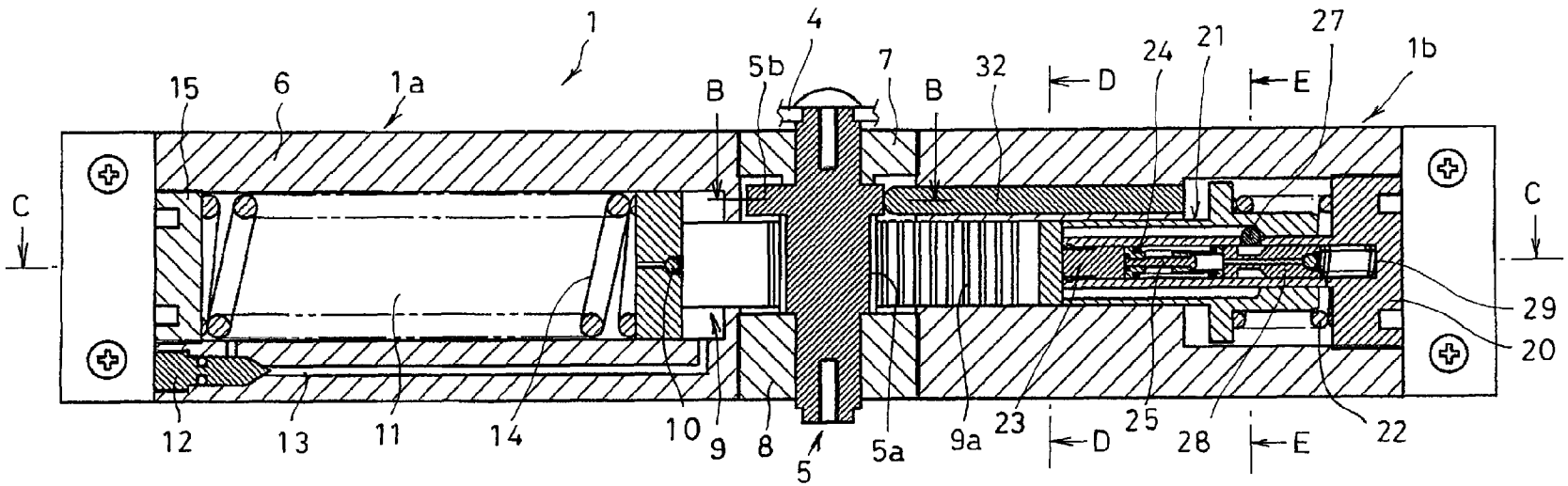
FIG. 3 is a cross-sectional view taken along a line A-A of FIG. 2.
Figure 4:
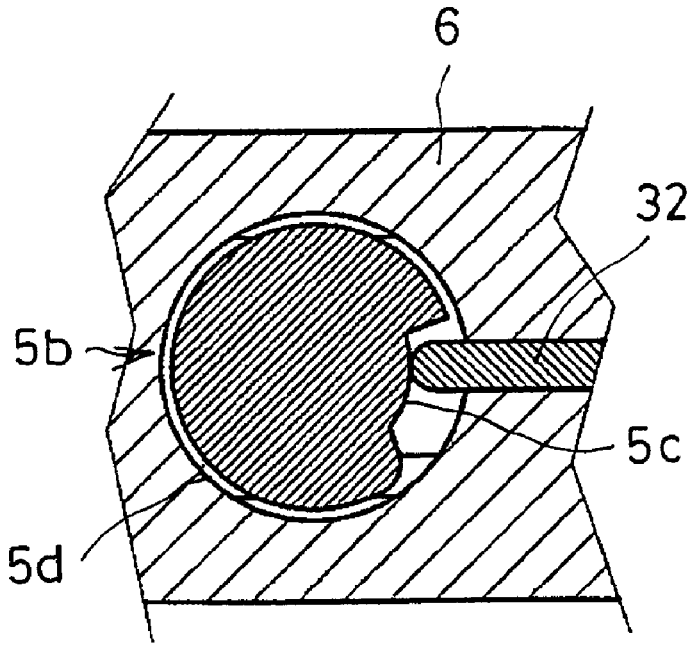
FIG. 4 is a cross-sectional view taken along the line B-B of FIG. 3.
Figure 5:
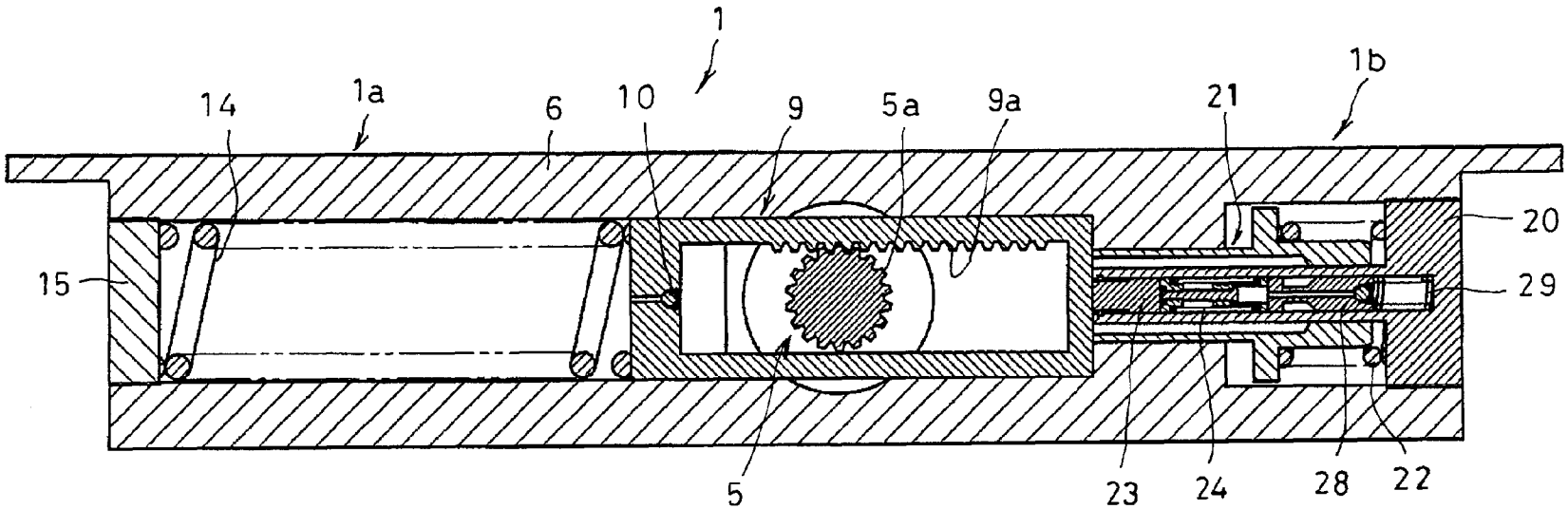
FIG. 5 is a cross-sectional view taken along the line C-C of FIG. 3.
Figure 6:
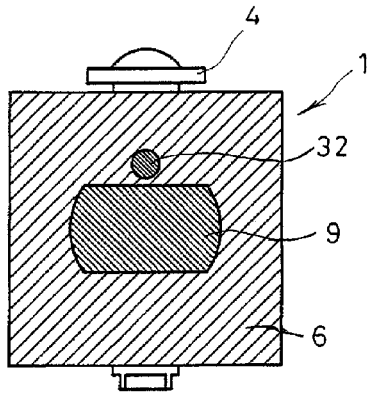
FIG. 6 is a cross-sectional view taken along the line D-D of FIG. 3.
Figure 7:
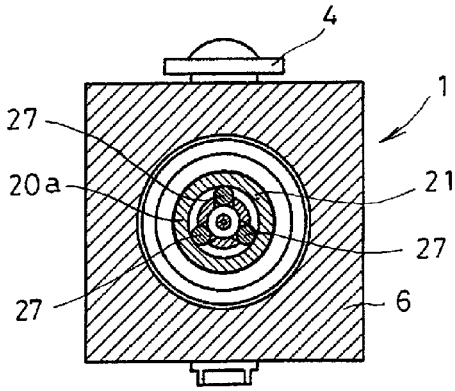
FIG. 7 is a cross-sectional view taken along the line E-E of FIG. 3.
Figure 8:
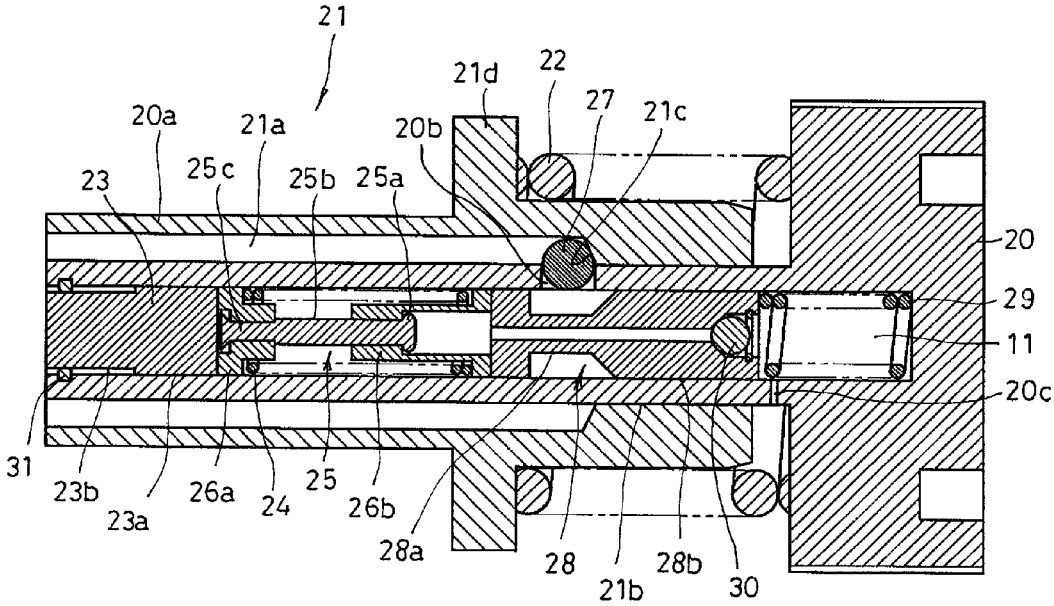
FIG. 8 is a partial section view showing a locking mechanism and an unlocking mechanism.

FIGS. 1 to 29 show one embodiment of the present invention. FIG. 1 is a front view of this embodiment; FIG. 2 is a left-side view of FIG. 1; FIG. 3 is a cross-sectional view along the line A-A of FIG. 2; FIG. 4 is a cross-sectional view along the line B-B of FIG. 3; FIG. 5 is a cross-sectional view along the line C-C of FIG. 3; FIG. 6 is a cross-sectional view along the line D-D of FIG. 3; FIG. 7 is a cross-sectional view along the line E-E of FIG. 3; FIG. 8 is a partial cross-sectional view of a locking mechanism and an unlocking mechanism; FIGS. 9 to 23 illustrate the actions of the door-opening-assistance device; and FIGS. 24 to 29 illustrate the actions of the unlocking spring and the locking spring corresponding to FIG. 8.

As shown in FIGS. 1 and 2, a door closer 1 in this embodiment is mounted, by using screws, at an upper part of a door 2 on the door's side that is inside a room or on the door's side that is outside the room, and is connected with a wall 3 via two parallel arms 4. The door closer 1 has a flat, horizontally rectangular case 6 that contains a closer 1*a* and an opening-assistance device 1*b*.

The closer 1*a* moves the door in the closing direction and provides force that is used to close the door, and, as shown in FIG. 3, consists of a pinion 5 that is connected with the arm 4, a cylinder 9 that is meshed with the pinion 5 and is linearly reciprocated along the longitudinal direction of the case 6, and a closing spring 14 that is made of a coil spring that moves the door 2 in the closing direction and provides force that is used to close the door 2.

The closer 1*a* is in the left-half area of the case 6 as shown in FIG. 3, being adjacent to the pinion 5. (The closer 1*a* and the opening-assistance device 1*b* are confronted with each other in the case 6, and the pinion 5 is sandwiched between the closer 1*a* and the opening-assistance device 1*b* as shown in FIG. 3.)

One end of the case 6 (the left end in FIG. 3) is sealed by screwing a cover 15 onto the case, and the other end (the right end in FIG. 3) is sealed by screwing a block 20, described below, that serves as a stationary member, onto the case. The inside of the case under this sealed condition is filled with oil 11.

The pinion 5 is at the approximate longitudinal center of the case 6, and is rotatably supported by plate-like supporting members 7 and 8, which are screwed together and fixed in the upper and lower portions, respectively, of the approximate center of the case 6. The rotary force that resulting from the movement of the door 2 is transmitted to the pinion 5 via the arm 4, and the pinion 5 rotates in the normal or reverse directions when the door 2 is opened or closed, respectively. In this embodiment, the pinion 5 rotates in the counterclockwise direction when the door 2 is opened and rotates in the clockwise direction when the door 2 is closed. A pinion gear 5*a*, with which the cylinder 9 meshes, is formed at the center of the longitudinal direction of the pinion 5, and a flange-shaped cam face 5*b* is formed in the upper portion of the pinion gear 5*a*.

A forward end of a shaft 32, described below, which is a moving member, contacts the cam face 5*b* of the pinion 5. As shown in FIG. 4, a small-diameter portion 5*c* and a large-diameter portion 5*d* are connected with each other in the circumferential direction so as to constitute the cam face 5*b*. A boundary portion between the small-diameter portion 5*c* and the large diameter portion 5*d* is formed so as to have a smooth inclined surface, so that the shaft 32 can move from the small-diameter portion 5*c* to the large-diameter portion 5*d*, and vice versa.

As shown in FIG. 5, the cylinder 9 is formed into a horizontally-elongated and approximately rectangular shape as seen from a plane view, and a rack 9*a* that is meshed with the pinion gear 5*a* of the pinion 5 is formed on the inner face in the longitudinal direction of the cylinder 9. When the pinion 5 rotates in the counterclockwise direction, which is the door-opening direction, the cylinder 9 moves in the case 6 in the direction shown as left in FIG. 5, and when the pinion rotates in the clockwise direction, which is the door-closing direction, the cylinder 9 moves in the direction shown as right in FIG. 5.

As shown in FIG. 3, a closing spring 14 is between the cylinder 9 and the cover 15, and the closing spring 14 causes the cylinder 9 to move toward the right, which is the door-closing direction. By this movement of the cylinder 9, the pinion 5 rotates in the clockwise direction, which is the door-closing direction. Accordingly, the closing spring 14 acts, via the cylinder 9 and the pinion 5, to moves the door 2 in the closing direction and provides force that is used to close the door 2 and therefore, the door 2 closes automatically.

A check-valve mechanism 10 is installed at the front end of the cylinder 9, being adjacent to the closing spring 14. When the cylinder 9 moves toward the right, which is the door-closing direction, the movement of the cylinder 9 is slowed by the resistance of the oil 11, so that the door 2 can be closed at a controlled speed. As shown in FIG. 3, a flow path 13 for the oil 11 is formed in the case 6 so as to correspond to the check-valve mechanism 10, and is passed through into the inside of the case 6. A regulating valve 12 is installed at the front end of the flow path 13. By moving the regulating valve 12 forward or backward, the volume of the oil flowing in the flow path 13 can be regulated. Thereby, the extent of the above-mentioned slowing of the movement of the cylinder 9 can be regulated.

As shown in FIGS. 3 and 8, the door-opening-assistance device 1*b* consists of a block 20 that serves as a stationary member, a moving member that consists of a piston 21 and a shaft 32, an unlocking mechanism that consists of an unlocking pin 23 and an unlocking spring 24, a locking mechanism that consists of a locking ball 27, a locking pin 28, and a locking spring 29, and an opening spring 22.

These components are inside the right half of the case 6, with the pinion 5 serving as a boundary between the two sides. The above-mentioned close device 1*a* is in the left half of the case 6, and the door-opening-assistance device 1*b* is in the right half. Therefore, the closer 1*a* and the door-opening-assistance device 1*b* are confronted with each other inside the case 6 in a straight line along the direction of the cylinder 9 reciprocating motion, so that the entire door closer 1 can be made flat and compact, resulting in an improved appearance and improved handling characteristics.

The block 20, which serves as a stationary member, is attached to the right end of the case 6 by screws, so as to be fixed to the case 6. A guide cylinder 20*a*, which extends toward the cylinder 9 along the moving direction of the cylinder 9, is integrally formed in the block 20. The piston 21 and the shaft 32, which constitute the moving member, are on the outer periphery of the guide cylinder 20*a*. The unlocking mechanism, which consists of the unlocking pin 23 and the unlocking spring 24, and the locking mechanism, which consists of the locking pin 28 and the locking spring 29, are on the inner periphery of the guide cylinder 20*a*.

As described above, the shaft 32 contacts the cam face 5*b* of the pinion 5, and moves to the right and to the left in the case 6 along and on the outside of the guide cylinder 20*a*. The piston 21 also moves to the right and to the left in the case 6 along the guide cylinder 20*a*. The movement of piston 21 is due to the force of the opening spring 22 and the force that results from the movement of the shaft 32.

As shown in FIG. 8, the piston 21 has a collar portion 21*d* that extends in the radial direction, and the opening spring 22 is between the collar portion 21*d* and the block 20. Also, the collar portion 21*d* can contact the shaft 32, and, as a result, the moving force from the shaft 32 is transmitted to the collar portion 21*d*. A large-diameter hole 21*a* and a small-diameter hole 21*b* are formed inside the piston 21, and the guide cylinder 20*a* of the block 20 slides in the small-diameter hole 21*b*. A tapered face 21*c* is formed at a boundary between the small-diameter hole 21*b* and the large-diameter hole 21*a*, and the locking ball 27 is at a portion corresponding to the tapered face 21*c*.

A locking ball 27 is provided at a position corresponding to a through-hole 20*b*—which is formed in the guide cylinder 20*a*—and the locking ball 27 can go into and out of the through-hole 20*b*. Also, the locking ball 27—while being fitted inside the through-hole 21*b*—contacts the tapered face 21*c* of the piston 21, so that the locking ball 27 acts so as to lock the movement of the piston 21. As shown in FIG. 7, multiple locking balls 27 are at three equally-spaced positions on the circumference of the inner surface of the piston 21, and therefore, their locking action onto the piston 21 can be made uniform along that circumference.

The locking pin 28 of the locking mechanism is formed by being connected a small-diameter portion 28*a* with a large-diameter portion 28*b*. The locking balls 27 can drop into the small-diameter portion 28*a*, which cancels the locking of the piston 21 by the locking balls 27. Also, the large-diameter portion 28*b* acts so as to maintain the locking balls 27 in contact with the tapered face 21*c* of the piston 21, which results in the piston 21 being locked. The locking spring 29 is a coil spring that causes the locking pin 28 to move toward the cylinder 9.

The unlocking pin 23 of the unlocking mechanism is at one end of the guide cylinder 20*a*, i.e., is adjacent to the cylinder 9, and the unlocking pin 23 moves forward from and backward into the guide cylinder 20*a*. The forward movement of the unlocking pin 23 is stopped when the unlocking pin 23 contacts a restriction ring 31, such as a C-ring, which is fitted at the tip of the guide cylinder 20*a*.

The unlocking spring 24 is a coil spring between the unlocking pin 23 and the locking pin 28. The unlocking spring 24 is provided so as to apply a spring force against the locking spring 29 of the locking mechanism. A stop pin 25, a first spring bearing 26*a*, and a second spring bearing 26*b* are arranged—in an assembled condition—against the unlocking spring 24.

As shown in FIG. 8, the stop pin 25 is structured such that a large-diameter portion 25*a*, an intermediate-diameter portion 25*b*, and a small-diameter portion 25*c* are connected with each other in the longitudinal direction. The first spring bearing 26*a* is adjacent to the unlocking pin 23, and the first spring bearing 26*a* clamps the end of the small-diameter portion 25*c* of the stop pin 25, which fixes the first spring bearing 26*a* to the stop pin 25. The second spring bearing 26*b* is adjacent to the locking pin 28, and the second spring bearing 26*b* slides along the intermediate-diameter portion 25*b* of the stop pin 25. This sliding is stopped at the large-diameter portion 25*a* of the stop pin 25. The unlocking spring 24 is compressed and is arranged—under the condition that the initial load of the spring force is set due to that compression—between the first spring bearing 26*a* and the second spring bearing 26*b*. The thus-set unlocking spring 24 can have a force larger than the spring force of the locking spring 29 when the opening spring 22 applies an opening force, and can have a force smaller than the spring force of the locking spring 29 when the opening spring 22 is locked under the condition of the opening force being stored.

Also, as shown in FIG. 8, a check-valve mechanism 30 is provided at one end of the locking pin 28, being adjacent to the locking spring 29, and a small-diameter flow path 20*c* is formed at the base portion—corresponding to the check-valve mechanism 30—of the guide cylinder 20*a*. Thereby, the oil 11 can circulate in the guide cylinder 20*a* and the case 6.

Figure 9:
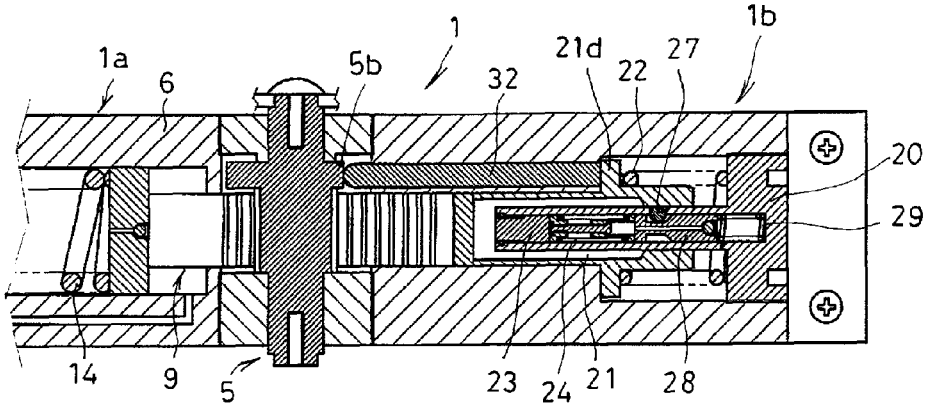
FIG. 9 is a cross-sectional view corresponding to FIG. 3, showing the condition of an opening-assistance device when a door has been fully opened.
Figure 10:
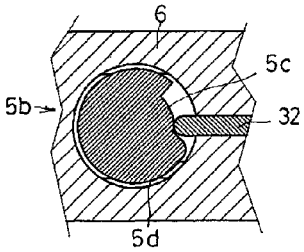
FIG. 10 is a cross-sectional view corresponding to FIG. 4, showing the condition of an opening-assistance device when a door has been=fully opened.
Figure 11:
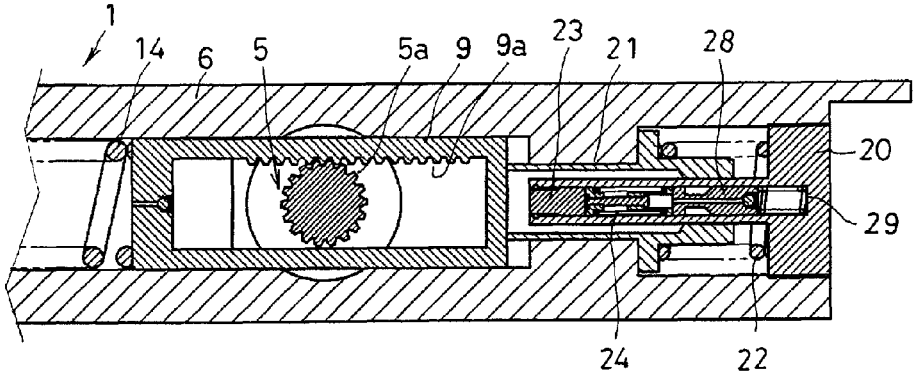
FIG. 11 is a cross-sectional view corresponding to FIG. 5, showing the condition of an opening-assistance device when a door has been=fully opened.
Figure 12:
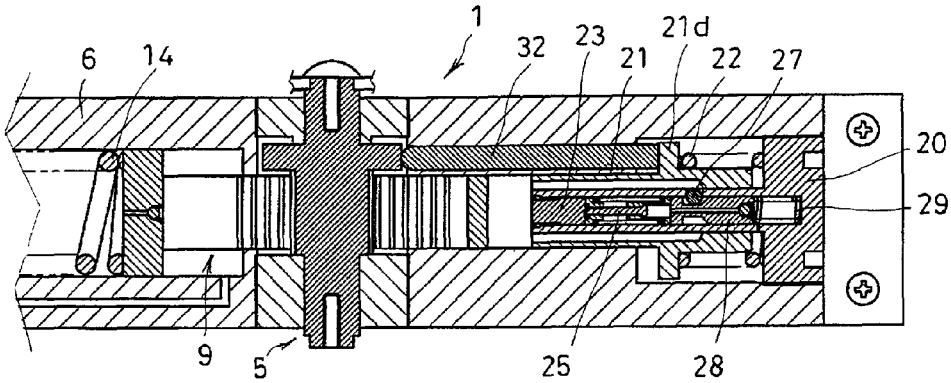
FIG. 12 is a cross-sectional view corresponding to FIG. 3, showing the opening-force-storing condition.
Figure 13:
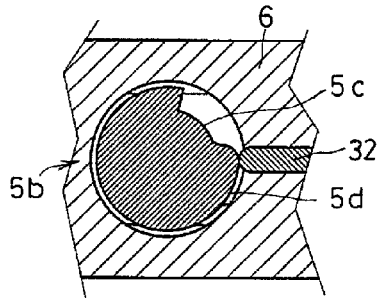
FIG. 13 is a cross-sectional view corresponding to FIG. 4, showing the opening-force-storing condition.
Figure 14:
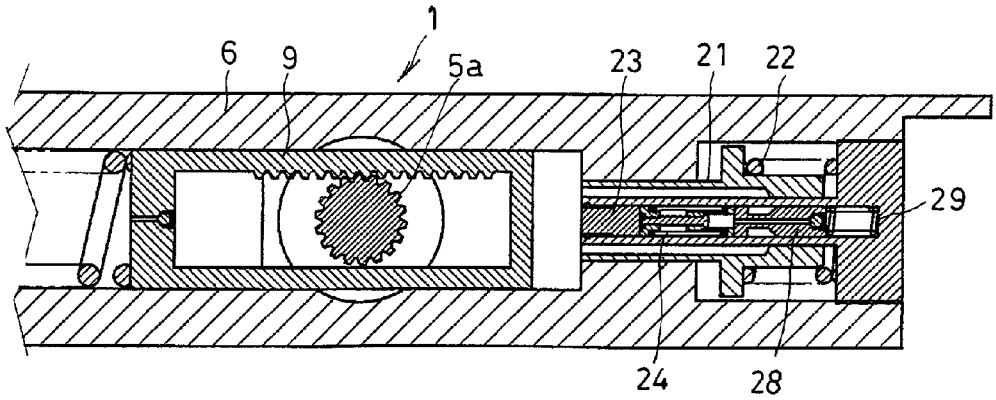
FIG. 14 is a cross-sectional view corresponding to FIG. 5, showing the opening-force-storing condition.
Figure 15:
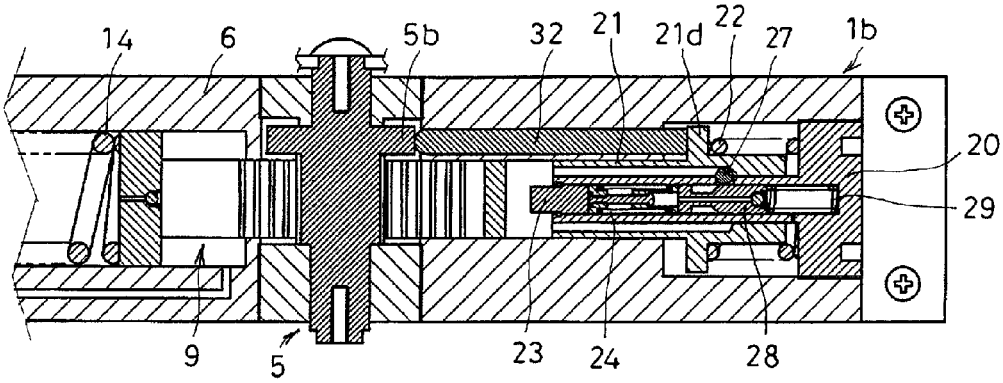
FIG. 15 is a cross-sectional view corresponding to FIG. 3, showing the condition when storing of the opening force is locked.
Figure 16:
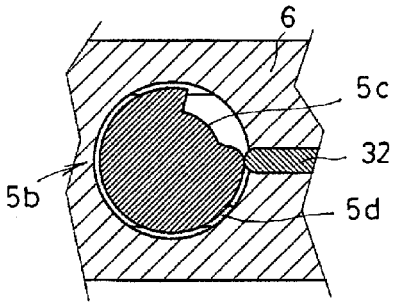
FIG. 16 is a cross-sectional view corresponding to FIG. 4, showing the condition when storing of the opening force is locked.
Figure 17:
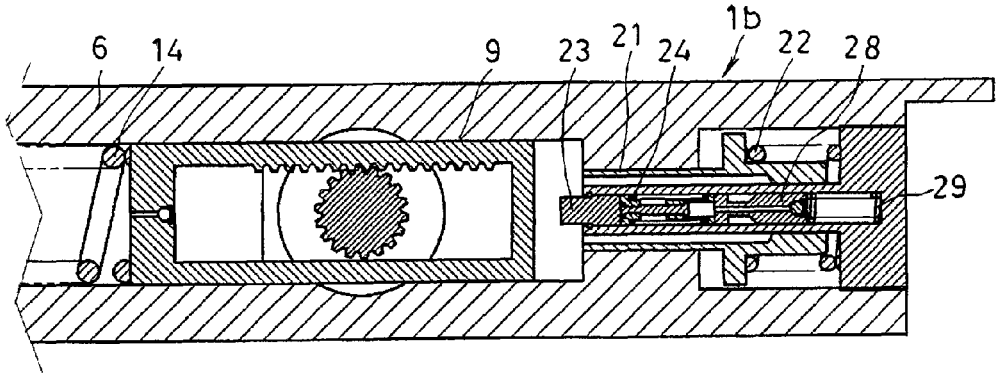
FIG. 17 is a cross-sectional view corresponding to FIG. 5, showing the condition when storing of the opening force is locked.
Figure 18:
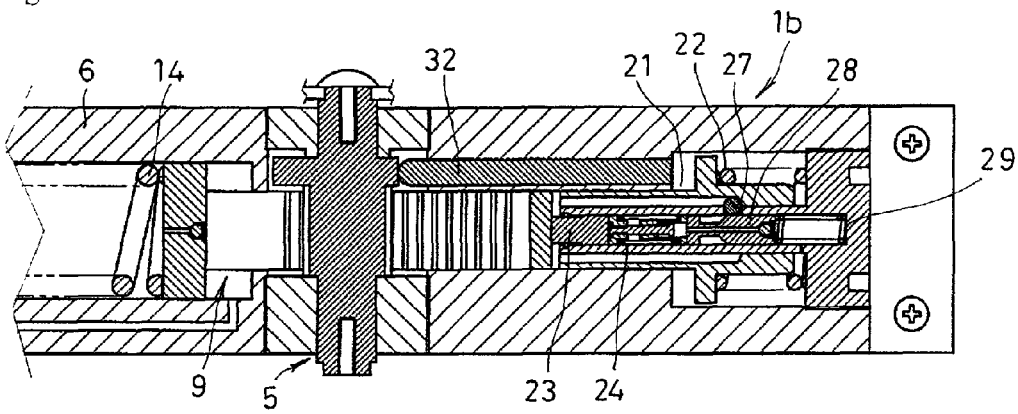
FIG. 18 is a cross-sectional view corresponding to FIG. 3, showing the condition immediately before the door is fully closed.
Figure 19:
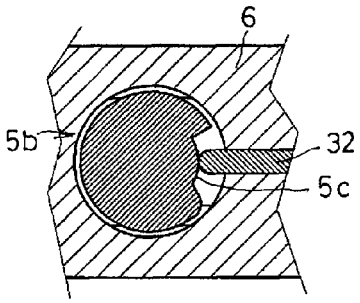
FIG. 19 is a cross-sectional view corresponding to FIG. 4, showing the condition immediately before the door is fully closed.
Figure 20:
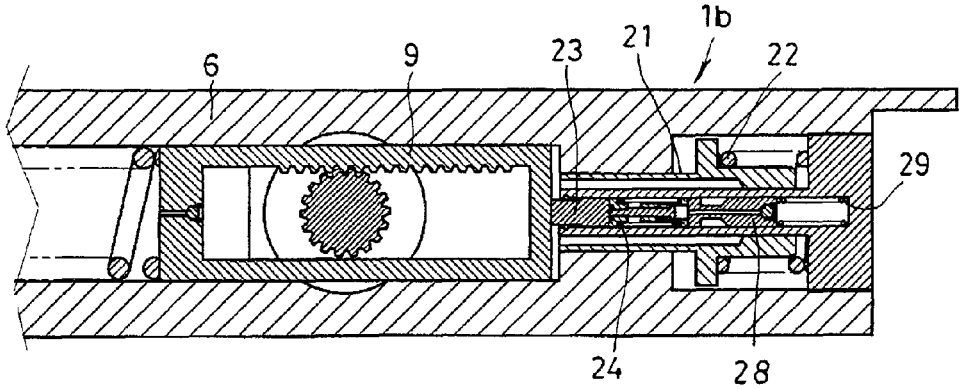
FIG. 20 is a cross-sectional view corresponding to FIG. 5, showing the condition immediately before the door is fully closed.
Figure 21:
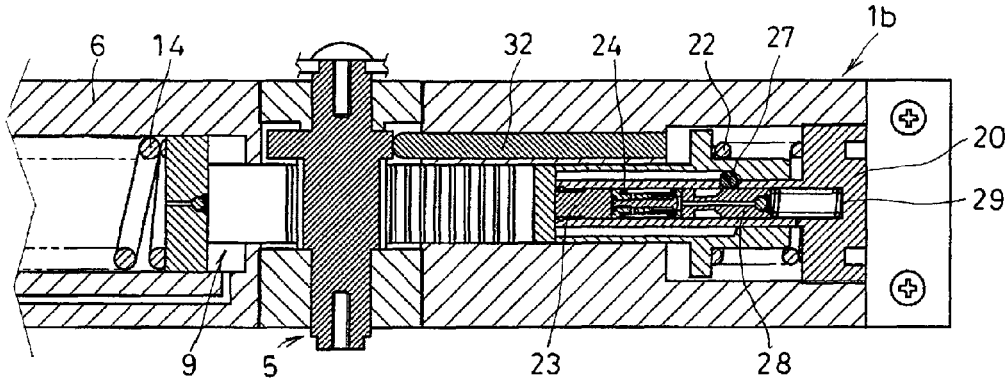
FIG. 21 is a cross-sectional view corresponding to FIG. 3, showing the condition when the door is fully closed.
Figure 22:
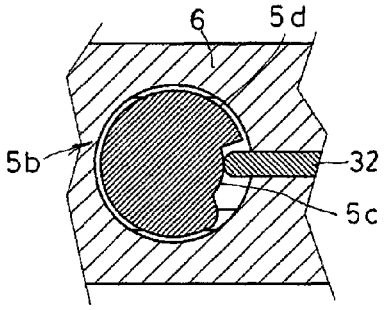
FIG. 22 is a cross-sectional view corresponding to FIG. 4, showing the condition when the door is fully closed.
Figure 23:
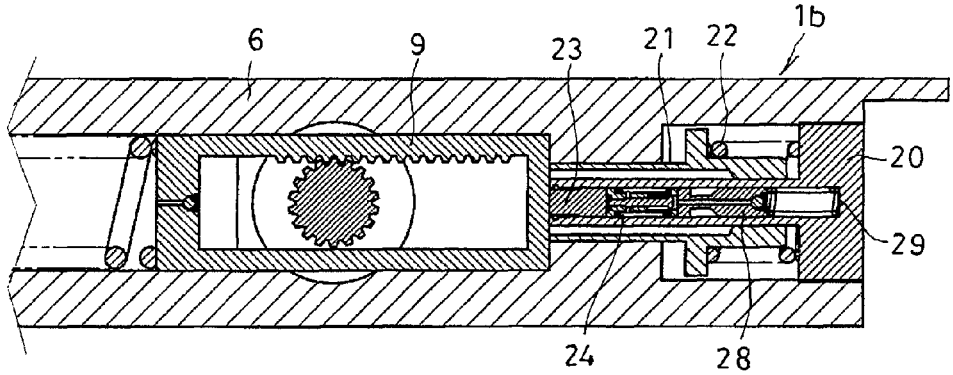
FIG. 23 is a cross-sectional view corresponding to FIG. 5, the condition when the door is fully closed.

The action of this embodiment of the door closer 1 will now be explained. FIGS. 3 to 5 show the condition of the door closer 1 when the door 2 is fully closed, where the latch key (not shown) is in a position such that the door 2 is locked. In this condition, the door-opening-assistance device 1*b* is in an unlocked condition. FIGS. 9 to 11 show the changes in the condition of the door closer 1 from the initial condition when the door 2 is fully closed to when the door 2 is being unlocked and then first being opened, during which time the opening force of the door-opening-assistance device 1*b* is applied. FIGS. 12 to 14 show the condition when the door 2 is further opened after the conditions shown in FIGS. 9 to 11. In this condition, the opening force of the door 2 is stored in the opening spring 22. FIGS. 15 to 17 show the condition when the opening spring 22 finishes storing the opening force and the opening-force-storing condition is locked. FIGS. 18 to 20 show the condition from when the door 2 is first being closed and to immediately before the door 2 is fully closed. FIGS. 21 to 23 show the condition when the door 2 is fully closed.

As shown in FIGS. 3 to 5, when the door-opening-assistance device 1*b* is in an unlocked condition, the cylinder 9 presses the unlocking pin 23 in the opening direction (to the right) of the door 2. At this time, the initial load of the spring force which is set to the unlocking spring 24 is set to be larger than the spring force of the locking spring 29, as described below. Therefore, the locking pin 28 is pressed in the same direction as the door-opening direction, and the small-diameter portion 28*a* of the locking pin 28 reaches the locking ball 27. In this case, the opening spring 22 is compressed to the maximum extent possible, and the forward end of the piston 21 presses—with the spring force of the opening spring 22—the cylinder 9 in the closing direction (to the left) of the door 2. Incidentally, the shaft 32 is in a free condition between the small-diameter portion 5*c* of the cam 5*b* of the pinion 5 and the collar 21*d* of the piston 21.

Under the conditions shown in FIGS. 3 to 5, when the latch key is in a position such that the door 2 is unlocked and the door 2 is actuated to open, the condition changes to that shown in FIGS. 9 to 11. FIGS. 9 to 11 show the condition when the door 2 rotates from the fully closed condition to and then beyond the opening-assistance area. When the latch key is in a position such that the door 2 is unlocked and the door 2 is actuated to open, the piston 21, which is pressed by the opening spring 22, presses the cylinder 9 to the left. This direction is opposite to the energizing direction of the closing spring 14 of the closer 1*a*, and the cylinder 9 moves in the same direction against the spring force of the closing spring 14. Therefore, the door 2 can be opened by a small amount of force.

Meanwhile, the tapered face 21*c* of the piston 21 presses the locking balls 27 to the left, and, as a result, a component force is applied to the locking balls 27 in the direction to drop the locking balls 27 into the small-diameter portion 28*a* of the locking pin 28. Accordingly, when the piston 21 moves, the locking balls 27 drop into the small-diameter portion 28*a*, and therefore the piston 21 can move to the left.

The locking balls 27 drop into the small-diameter portion 28*a* of the locking pin 28, and therefore the movement of the locking pin 28 is restrained. Therefore, the locking spring 29 is maintained under a compressed condition, so that the unlocking spring 24 is held in a condition such that an initial load is set thereon by the stop pin 25 and the spring bearings 26*a*, 26*b*. During this time, the door 2 can be opened with a small amount of force, thanks to the spring force of the opening spring 22. The shaft 32, which has moved to the terminal end of the opening-assistance area, contacts the end of the small-diameter portion 5*c* of the cam face 5*b* of the pinion 5, and becomes nipped between that small-diameter portion 5*c* and the collar 21*d* of the piston 21.

When the door 2 is actuated to open further than the end of the opening-assistance area that is shown in FIGS. 9 to 11, the large-diameter portion 5*d* contacts the shaft 32—due to the rotation of the pinion 5—via the smooth inclined face of the cam face 5*b* from the small-diameter portion 5*c* of the cam face 5*b*, as shown in FIGS. 12 to 14. Therefore, the shaft moves to the right, and the piston 21 is pressed in the same direction by the shaft 32. As a result, the opening spring 22 is compressed, storing the opening force for the door 2. Other members maintain the conditions shown in FIGS. 9 to 11.

By the movement shown in FIGS. 12 to 14, the large-diameter hole 21*a* of the piston 21 reaches a position that corresponds to the locking ball 27. FIGS. 15 to 17 show the subsequent condition. At this subsequent time, the unlocking spring 24 maintains the initial load that was set by the stop pin 25 and the spring bearings 26*a*, 26*b*, and, therefore, a spring force that acts on the outside (i.e., on the locking pin 28) is not generated. The locking spring 29 is held in a compressed condition as illustrated in FIGS. 9 to 11, and, as a result, the locking pin 28 moves to the left due to the spring force of the locking spring 29. Also, at this time, the locking ball 27 is out of the small-diameter hole 21*b* of the piston 21, and therefore, the locking ball 27 is pressed upward by the large-diameter portion 28*b* of the locking pin 28 to the outside from the through-hole 20*b*, and the locking ball 27 contacts the tapered face 21*c* of the piston 21, thereby locking the piston 21.

In this manner, the locked condition caused by the locking ball 27 continues thereafter. Therefore, even when the door 2 is further opened, the door-opening-assistance device 1*b* does not contribute to the opening/closing of the door 2. As described above, after the opening spring 22 applies the opening force for the door 2 at the initial stage of the opening of the door 2, the opening spring 22 stores the opening force for the door 2 and is locked under the opening-force-storing condition. In this structure, before the door 2 is opened enough to allow people to pass through the doorway, the assistance action of the door opening and the storage of the door-opening force can be completed sequentially. Therefore, even if the door 2 is closed after having been opened only a little (i.e., closed before it is fully opened), there does not occur any malfunction such that the opening spring 22 fails to store the opening force.

FIGS. 18 to 20 show the conditions from the opening of the door 2, to the closing of the door 2 immediately before it is fully closed. By the closing of the door 2, the pinion 5 rotates in the clockwise direction, by which the one end of the cylinder 9 presses against the unlocking pin 23, so that the unlocking pin 23 moves to the right. By this movement, the unlocking spring 24 is gradually compressed. At this time, the locked condition caused by the locking balls 27 is still maintained.

When the door 2 is fully closed after the conditions shown in FIGS. 18 to 20, the door comes into the conditions shown in FIGS. 21 to 23. When the door 2 is fully closed, the spring force of the unlocking force 24 is set larger than the combined force of the locking balls 27, which presses the locking pin 28, and the locking spring 29, as described below. Therefore, the locking pin 28 moves to the right so as to compress the locking spring 29. This movement is slowed by the action of the check-valve mechanism 30, and therefore, the locking pin 28 moves slowly until the position of the small-diameter portion 28*a* corresponds to that of the locking balls 27. Due to this slowing action, the latch key is in a position such that the door 2 is locked, and then the door comes into the unlocked condition shown in FIGS. 3 to 5.

In this embodiment, the door-opening-assistance device 1*b* that applies pressure to keep the door 2 in the opening direction is inside the same case 6 together with the closer 1*a* , which moves the door 2 in the closing direction and provides force that is used to close the door 2, so that the entire door closer can be made compact and can have an improved appearance. Also, the operation of the door-opening-assistance device 1*b* and that of the close device 1*a* are interlinked with the opening of the door 2, and therefore, there is no need for troublesome adjustment of the functioning of these two devices. Also, a number of parts is small, resulting in less failure.

The above-mentioned actions of the unlocking spring 24 and the locking spring 29 will now be explained with reference to FIGS. 24 to 29. Here, FIG. 24 corresponds to FIGS. 3 to 5, FIG. 25 corresponds to FIGS. 9 to 11, FIG. 26 corresponds to FIGS. 12 to 14, FIG. 27 corresponds to FIGS. 15 to 17, FIG. 28 corresponds to FIGS. 18 to 20, and FIG. 29 corresponds to FIGS. 21 to 23.

Figure 24:
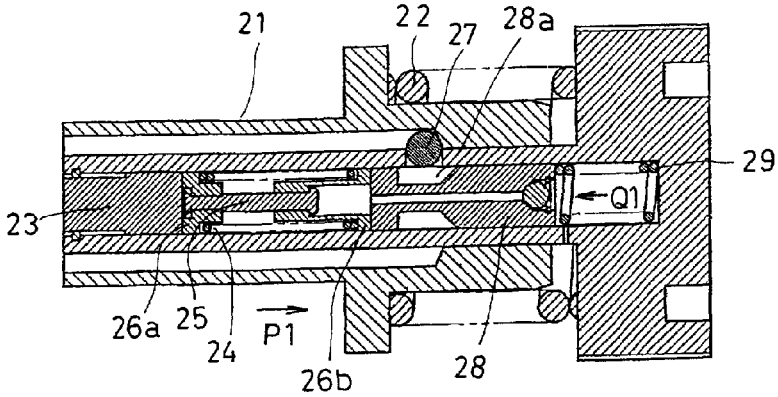
FIG. 24 is a cross-sectional view that illustrates the actions of an unlocking spring and a locking spring under the conditions of FIGS. 3 to 5.

As described above, the unlocking spring 24 is set to both the first spring bearing 26*a* and the second spring bearing 26*b*, and the second spring bearing 26*b* can slide along the longitudinal direction of the stop pin 25. This sliding is stopped at the large-diameter portion 25*a* of the stop pin 25. Under the conditions shown in FIGS. 3 to 5, where the latch key is in a position such that the door 2 is locked and the door-opening-assistance device 1*b* is unlocked, the unlocking spring 24 has an initial load P1, and no force R that is applied to the outside by the unlocking spring 24 is generated (i.e., R=0), as shown in FIG. 24. Meanwhile, the locking spring 29 is compressed to the maximum extent possible, and its load is Q1. Also, the load when the locking spring 29 is extended to the maximum extent possible is Q2.

The relationship between the forces of the unlocking spring 24 and the locking spring 29 is expressed as Q2, Q1<P1. Also, due to the cylinder 9, the unlocking spring 23 cannot move to the left. As a result, Q1<P1 is satisfied, and the acting force R to the outside is 0, and therefore, the locking spring 29 remains in the unlocked position.

Figure 25:
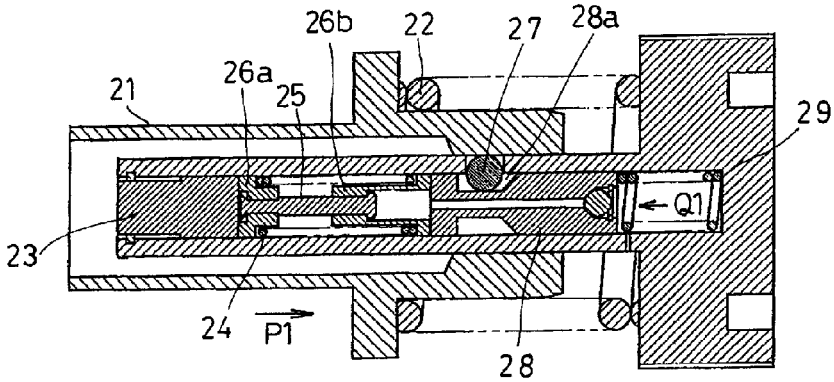
FIG. 25 is a cross-sectional view that illustrates the actions of an unlocking spring and a locking spring under the conditions of FIGS. 9 to 11.

Under the condition that the door 2 is actuated to open from a fully-closed condition, the door 2 moves into the opening-assistance area and reaches the terminal end of that area (the condition shown in FIGS. 9 to 11), the locking opening-assistance balls 27 drop into the small-diameter portion 28*a*, so that the locking pin 28 is locked, as shown in FIG. 25. At this time, the loads on the unlocking spring 24 and the locking spring 29 remain in the condition shown in FIG. 24.

Figure 26:
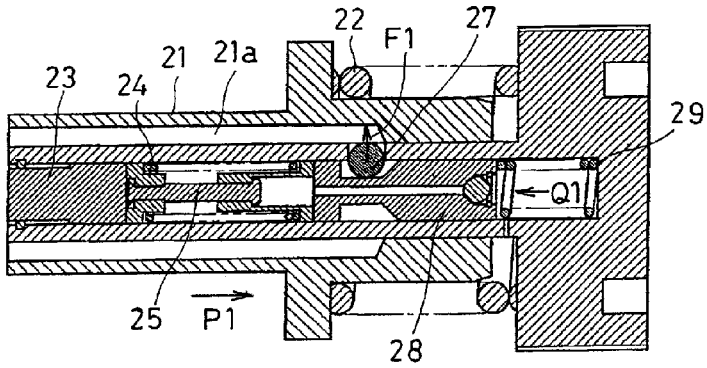
FIG. 26 is a cross-sectional view that illustrates the actions of an unlocking spring and a locking spring under the conditions of FIGS. 12 to 14.

Under the condition that the opening spring 22 is compressed and the opening force is stored (the condition shown in FIGS. 12 to 14), the locking balls 27 move toward the piston 21 and the locking pin 28 is unlocked, as shown in FIG. 26. At this time, the moving force of the locking balls 27 toward the unlocked position is F1, and there is no restriction from the unlocking pin 23. Therefore, the locking spring 29 presses the locking pin 28 with a force larger than the force F1, and therefore the locking pin 28 moves to the left.

Figure 27:
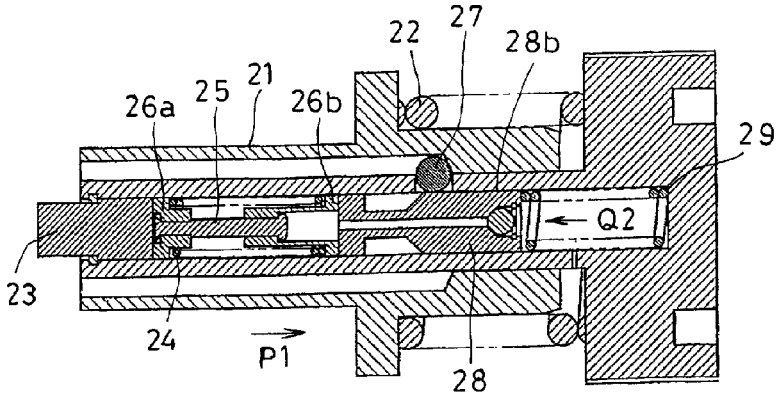
FIG. 27 is a cross-sectional view that illustrates the actions of an unlocking spring and a locking spring under the conditions of FIGS. 15 to 17.

Under the condition that the opening spring 22 is locked in an opening-force-storing condition (the condition shown in FIGS. 15 to 17), the relationship F1<Q2<Q1 is satisfied, and also the acting force R of the unlocking spring 24 toward the outside is 0. Therefore, as shown in FIG. 27, the locking pin 28 can surely move to the locking position, i.e., until the locking balls 27 contact the tapered face 21*c* of the piston 21 by the spring force of the locking spring 29.

Figure 28:
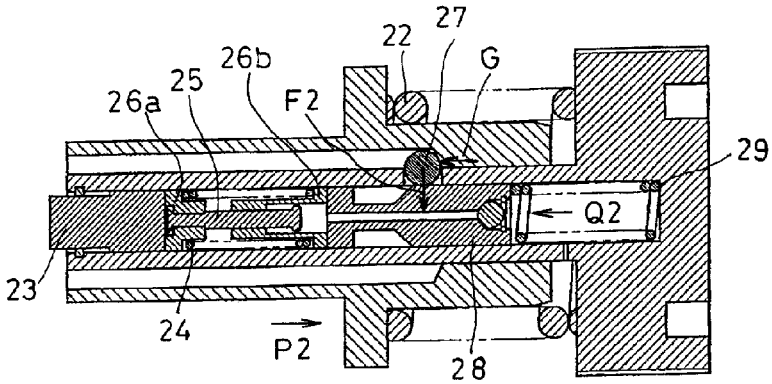
FIG. 28 is a cross-sectional view that illustrates the actions of an unlocking spring and a locking spring under the conditions of FIGS. 18 to 20.

Under the condition that the door 2 is moved just before it is fully closed by the closing action (the condition shown in FIGS. 18 to 20), the unlocking spring 24 is compressed further than is provided for by the initial load setting, and so the load of the unlocking spring 24 is P2, as shown in FIG. 28. The force G is applied to the locking balls 27 by the spring force of the opening spring 22, and therefore, the force F2 is applied to the locking pin 28. The force for moving the locking pin 28 against the force F2 is expressed as F2×μ (μ is a coefficient of friction). At this time, the relationship P2≧(F2×μ)+Q2 is satisfied, and therefore the locking pin 28 starts to move to the right.

Figure 29:
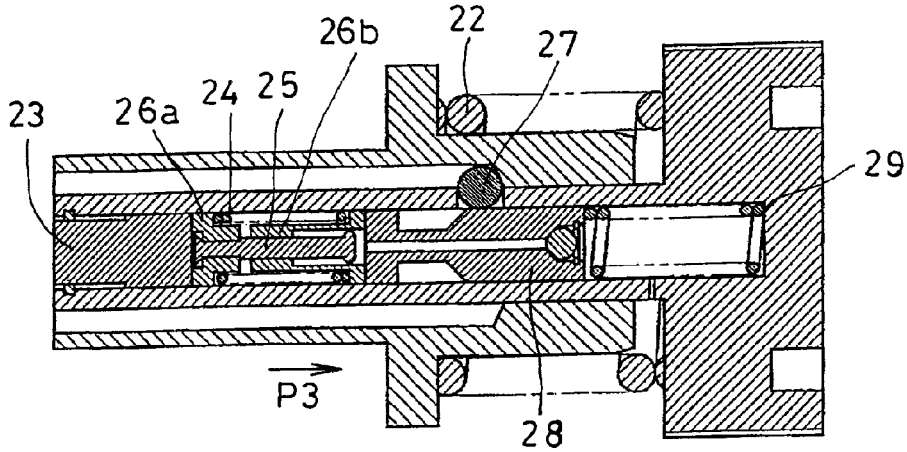
FIG. 29 is a cross-sectional view that illustrates the actions of an unlocking spring and a locking spring under the conditions of FIGS. 21 to 23.

Under the condition that the door 2 is fully closed (the condition shown in FIGS. 21 to 23), the unlocking spring 24 is compressed to the maximum extent possible, and the load thereon is P3, as shown in FIG. 29. At this time, the relationship, P3>(F2×μ)+Q2, is satisfied, and therefore, the locking pin 28 can unfailingly move to the unlocking position, which is the condition shown in FIGS. 3 to 5. At the end of this movement of the locking pin 28, the load on the unlocking spring 24 is P1, which is the initially set load. Therefore, the force R, which acts on the outside, becomes 0, and the locking pin 28 can stop at the unlocking position.

In this embodiment, as described above, an initial spring-force load is set on the unlocking spring 24, and therefore, the opening force of the opening spring 24 can act unfailingly. In addition, the opening spring 22 can surely be locked under the opening-force-storing condition.

Figure 30:
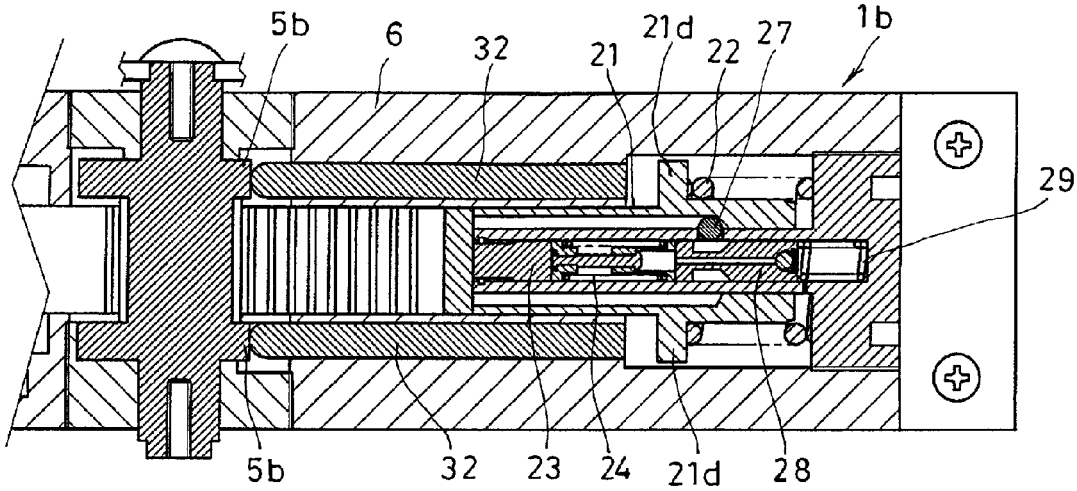
FIG. 30 is a partial section view of a second embodiment of the present invention.
Figure 31:
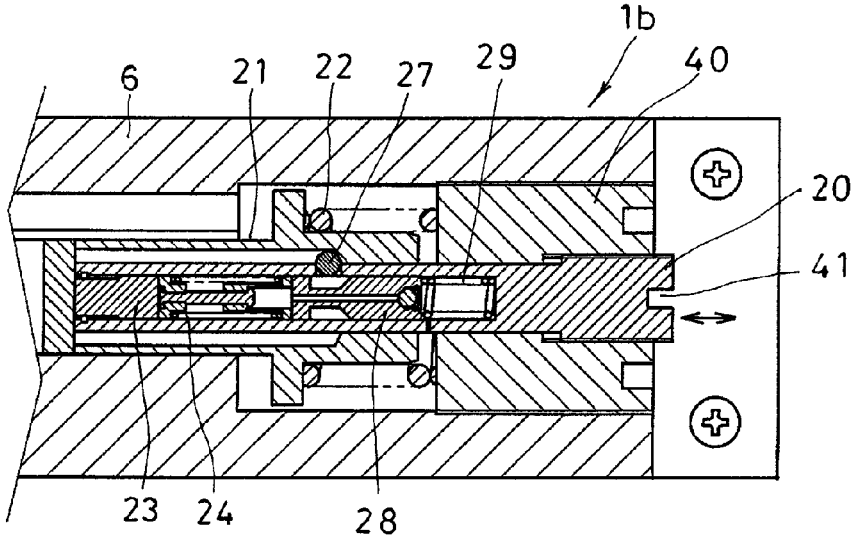
FIG. 31 is a partial section view of a third embodiment of the present invention.

FIGS. 30 and 31, respectively, show other embodiments of the present invention.

In the embodiment shown in FIG. 30, two parallel shafts 32 move between the pinion 5 and the piston 21. Against each of the shafts 32, the cam face 5*b* is formed on the pinion 5, and the two shafts 32 simultaneously act on the pinion 5. Therefore, no imbalanced load is applied, and thus the door-opening-assistance device 1*b* can operate smoothly.

In the embodiment shown in FIG. 31, a block 20, which is a stationary member, is mounted by screws to a supporting block 40 that, in turn, is mounted by screws to a case 6. In this case, it is possible to adjust—in the longitudinal direction—the position at which the block 20 is mounted to the supporting block 40, by rotating the block 20 in the forward direction or reverse direction. For the purpose of such adjustment, a tool groove 41, into which a tool such as a screwdriver is to be inserted, is formed on the backward end face of the block 20. In this structure, the mounting position of the block 20 can be adjusted appropriately, and therefore it is possible to adjust the timing for bringing the cylinder 9, the piston 21, and the unlocking pin 23 into contact with the block 20.

Figure 32:
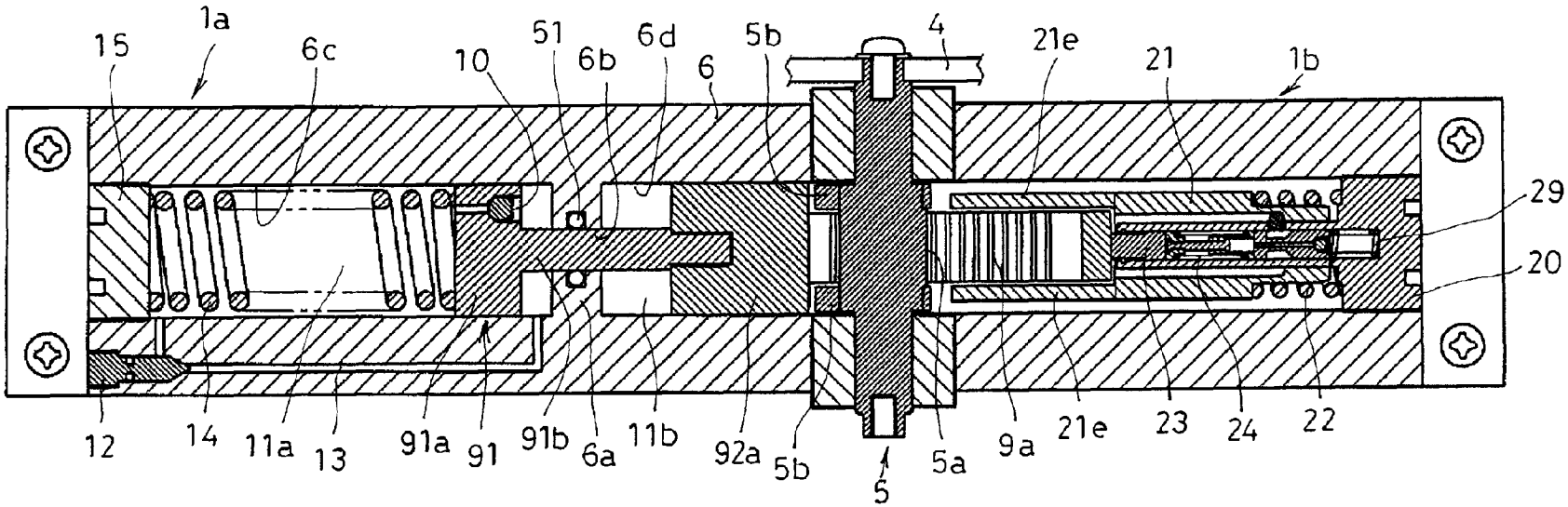
FIG. 32 is a cross-sectional view of a fourth embodiment of the present invention.
Figure 33:
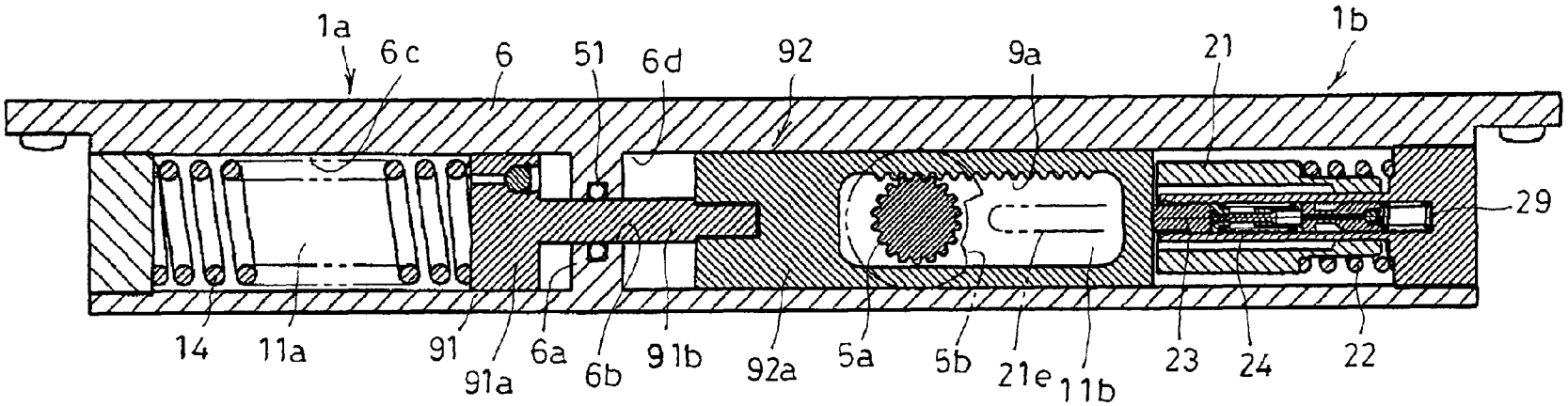
FIG. 33 is a cross-sectional view perpendicular to that of FIG. 32.

FIGS. 32 and 33 further show other embodiments of the present invention. FIG. 32 is a cross-sectional view corresponding to FIG. 3, and FIG. 33 is a cross-sectional view corresponding to FIG. 5.

In this embodiment, a partition 6*a* is provided at the middle of the case 6, so that inside the case a first chamber 6*c* and a second chamber 6*d* are adjacent to each other and on the left and ride sides, respectively, of the partition. By sealing the partition 6*a*, as described below, the first chamber 6*c* and the second chamber 6*d* are isolated from each other inside the case 6. Accordingly, the first chamber 6*c* and the second chamber 6*d* are independent from each other, and therefore, oils 11*a* and 11*b* that are filled inside either chamber do not enter the other chamber.

Also, the cylinder 9, which is a component of the closer 1*a*, is formed of two members, i.e., a first cylinder part 91 and a second cylinder part 92. The first cylinder part 91 is in the first chamber 6*c* of the case 6, and the second cylinder part 92 is in the second chamber 6*d*.

The first cylinder part 91 has a large-diameter flange 91*a* and a small-diameter shaft 91*b* that extends from the large-diameter part 91*a* in the longitudinal direction of the case 6. The large-diameter flange 91*a* slides along the inner surface of the first chamber 6*c*, so as to be guided in the first chamber 6*c*, as a result of which the entire first cylinder part 91 moves forward and backward in the longitudinal direction inside the first chamber 6*c*. A check-valve mechanism 10 is provided at an axially penetrated portion in the flange 91*a*. Also, an oil flow path 13 is formed so as to connect the front and back ends—in the sliding direction of the first cylinder part 91—of the first chamber 6*c*, and a regulating valve 12 is provided in the oil flow path 13.

The shaft 91*b* slideably penetrates the partition 6*a* so that the forward end of the shaft 91*b* enters the second chamber 6*d*. A through-hole 6*b*, which the shaft 91*b* penetrates, is formed in the partition 6*a* so that the shaft 91*b* can achieve such entry. A seal 51 is provided in the through-hole 6*b*, so that the first chamber 6*c* is isolated from the second chamber 6*d*. However, the space between the through-hole 6*b* and the shaft 91*b* can be made small so as to isolate the first chamber 6*c* from the second chamber 6*d*, so that the seal 51 can be omitted.

The second cylinder part 92 in the second chamber 6*d* has a cylindrical block part 92*a* that slides along the inner surface of the second chamber 6*d*. Accordingly, the second cylinder part 92 can be guided in the second chamber 6*d* so as to move forward and backward in the longitudinal direction of the case 6. As shown in FIG. 33, the block part 92*a* extends in the direction of the door-opening-assistance device 1*b* on both sides of the pinion 5. A rack 9*a*, which is to mesh with the pinion gear 5*a* of the pinion 5, is formed on the surface—opposed to the pinion 5—of the extended portion of the block part 92*a*. The second cylinder part 92 is connected with the first cylinder part 91 by being screw-coupled to the forward end of the shaft 91*b* of the first cylinder part 91. Under this connected condition, the first cylinder part 91 and the second cylinder part 92 operate integrally.

In this embodiment, as is similar to the embodiment shown in FIG. 30, two cam faces 5*b* are formed at the upper and lower portions of the pinion 5. Meanwhile, projections 21*e* of the piston 21 of the door-opening-assistance device 1*b* extend in the direction of the cam faces 5*b* so as to correspond to the respective cam faces 5*b*. Accordingly, the two projections 21*e* simultaneously act on the piston 5. As a result, the piston 5 does not receive an imbalanced load, and the door-opening-assistance device 1*b* can operate smoothly.

In this embodiment, the closing spring 14 and the first cylinder part 91 are in the first chamber 6*c* of the case 6, and the second cylinder part 92, the piston 5, and the door-opening-assistance device 1*b* are inside the second chamber 6*d*. The door-opening-assistance device 1*b* includes an unlocking mechanism, consisting of the locking pin 23 and the unlocking spring 24, both of which have already been described, a locking mechanism, consisting of the locking balls 27 and the locking spring 29, both of which have already been described, an opening spring 22, and the above-mentioned piston 21, and the door-opening-assistance device 1*b* operates in a manner similar to that of the above-mentioned embodiment.

Also, the first cylinder part 91 and the second cylinder part 92 are connected with each other by screwing the shaft 91*b* into the second cylinder part 92. Therefore, the first cylinder part 91 and the second cylinder part 92 integrally slide in the same direction of reciprocating motion. Furthermore, the first chamber 6*c* is filled with oil 11*a*, and the second chamber 6*d* is filled with oil 11*b*.

In this embodiment, due to the closing of the door, the first cylinder part 91 moves to the right, and the oil 11*a*, which is on the front side in the moving direction of the first cylinder part 91, is made to move through the check-valve mechanism 10, the flow path 13, and the regulating valve 12. Accordingly, the door is closed in slowly, obtaining a damper effect. At this time, high pressure acts on the oil 11*a* in the first chamber 6*c*. However, because the second chamber 6*d* is isolated from the first chamber 6*c*, the pressure in the first chamber 6*c* is not transmitted to the second chamber 6*d*. Accordingly, the door-opening-assistance device 1*b* in the second chamber 6*d* can operate with only the torque balance between the unlocking spring 24 and the locking spring 29, and the door-opening-assistance device 1*b* is under such an independent condition and operates smoothly. Thus, opening of the door can surely be assisted.

In addition, the door-closing speed can be adjusted by using the regulating valve 12. In this adjustment, the pressure on the oil 11*a* in the first chamber 6*c* changes, but there is no influence on the second chamber 6*d*, which is isolated from the first chamber 6*c*. Accordingly, even when the door-closing speed is changed, the door-opening-assistance device 1*b* in the second chamber 6*d* can operate smoothly.

INDUSTRIAL APPLICABILITY

In the door closer of the present invention, the door-opening-assistance device, which provides door-opening force that can be used to counter the door closer's door-closing force, and the closer, which moves the door in the closing direction and provides force that is used to close the door, are in the same case in a manner so that their functioning is interlinked with the opening of the door. Therefore, the door closer has only a small number of parts, and there is no need for troublesome adjustment when it is assembled. In addition, the door closer has an attractive appearance, and therefore it can be used for various kinds of doors where an attractive appearance is necessary.

What is claimed is:

1. A door closer, comprising:

a closer that includes a pinion that rotates in the forward and reverse directions together due to the opening and closing, respectively, of a door, a cylinder that is meshed with the pinion and moves forward and backward, and a closing spring that, via the cylinder and the pinion, provides force that is used to close the door, and an opening-assistance device that includes an opening spring that stores a door-opening force due to the rotation of said pinion when the door is opened, a locking mechanism that locks the opening spring in the opening-force-storing condition when the door is opened, and an unlocking mechanism that unlocks the locking mechanism when the door is closed, and wherein said closer and said opening-assistance device are inside a same case so that the functioning of said closer and that of said opening-assistance device are interlinked when the door is opened, and wherein said opening-assistance device comprises said opening spring, said locking mechanism, said unlocking mechanism, a fixing member that extends along the moving direction of said cylinder under a fixed condition at one end of said case, and a moving member that receives the force of said opening spring, that can make contact with said cylinder, and that moves along the fixing member due to the moving force between itself and the cylinder, and wherein said locking mechanism has locking balls that lock the movement of the moving member when the door is opened and lock the opening spring in an opening-force-storing condition, and due to the closing of the door, said moving member releases the locking balls' locking of the movement of the moving member.

2. The door closer as described in claim 1, wherein said case is separated into a first and second chambers that are isolated from each other, said cylinder includes of a first cylinder part that receives the force of the closing spring, and a second cylinder part that is meshed with the pinion, the closing spring and the first cylinder part are inside said first chamber, and the pinion, the second cylinder part, and the door-opening-assistance device are inside said second chamber, with the first and second cylinder parts connected with each other.

3. The door closer as described in claim 2, wherein said closer and said opening-assistance device are confronted with each other inside the case in a straight line along the direction of said cylinder reciprocating motion.

4. The door closer as described in claim 2, wherein said opening spring applies the opening force due to the rotation of said pinion within a predetermined angle at an initial door-opening stage, stores the opening force, and is locked in the opening-force-storing condition.

5. The door closer as described in claim 2, wherein there is formed on said pinion a cam face that contacts the moving member, and the cam face is formed so that the opening spring applies the opening force due to the rotation of the pinion within a predetermined angle at the initial stage of the opening of the door, stores the opening force, and is locked in the opening-force-storing condition.

6. The door closer as described in claim 2, wherein said locking mechanism has a locking spring that moves said locking balls to a position for locking the movement of the moving member, said unlocking mechanism has an unlocking spring that opposes the locking spring, and said unlocking spring has a spring force that is larger than the spring force of the locking spring when the initial load of the spring force is set so that said opening spring applies the opening force, and that is smaller than the spring force of the locking spring when said opening spring is locked in the opening-force-storing condition.

7. The door closer as described in claim 1, wherein said closer and said opening-assistance device are confronted with each other inside the case in a straight line along the direction of said cylinder reciprocating motion.

8. The door closer as described in claim 7, wherein said locking mechanism has a locking spring that moves said locking balls to a position for locking the movement of the moving member, said unlocking mechanism has an unlocking spring that opposes the locking spring, and said unlocking spring has a spring force that is larger than the spring force of the locking spring when the initial load of the spring force is set so that said opening spring applies the opening force, and that is smaller than the spring force of the locking spring when said opening spring is locked in the opening-force-storing condition.

9. The door closer as described in claim 1, wherein said opening spring applies the opening force due to the rotation of said pinion within a predetermined angle at an initial door-opening stage, stores the opening force, and is locked in the opening-force-storing condition.

10. The door closer as described in claim 1, wherein there is formed on said pinion a cam face that contacts the moving member, and the cam face is formed so that the opening spring applies the opening force due to the rotation of the pinion within a predetermined angle at the initial stage of the opening of the door, stores the opening force, and is locked in the opening-force-storing condition.

11. The door closer as described in claim 1, wherein said locking mechanism has a locking spring that moves said locking balls to a position for locking the movement of the moving member, said unlocking mechanism has an unlocking spring that opposes the locking spring, and said unlocking spring has a spring force that is larger than the spring force of the locking spring when the initial load of the spring force is set so that said opening spring applies the opening force, and that is smaller than the spring force of the locking spring when said opening spring is locked in the opening-force-storing condition.

* * * * *